US005088628A

United States Patent [19]

Knickerbocker

[11] Patent Number: 5,088,628

[45] Date of Patent: Feb. 18, 1992

[54] DISPENSER HAVING CHILD-RESISTANT NOZZLE ASSEMBLY

[75] Inventor: Michael G. Knickerbocker, Upland, Calif.

[73] Assignee: Calmar Inc., Watchung, N.J.

[21] Appl. No.: 552,068

[22] Filed: Jul. 13, 1990

[51] Int. Cl.[5] ..... B65D 50/00

[52] U.S. Cl. ..... 222/153; 222/380; 222/383; 215/221

[58] Field of Search ..... 222/153, 321, 341, 383, 222/380, 384, 385; 239/333, 394; 215/28, 225, 218, 219, 220, 221

[56] References Cited

U.S. PATENT DOCUMENTS

| | | | |
|---|---|---|---|
| 3,514,003 | 5/1970 | Fitzgerald | 215/221 |
| 4,350,298 | 9/1982 | Tada | 222/380 |
| 4,512,484 | 4/1985 | Mar | 215/221 |
| 4,971,227 | 11/1990 | Knickerbocker et al. | 222/153 |

*Primary Examiner*—Michael S. Huppert
*Assistant Examiner*—Anthoula Pomrening
*Attorney, Agent, or Firm*—Watson, Cole, Grindle & Watson

[57] ABSTRACT

A child-resistant element in the form of an overcap surrounds a rectangular-shaped nozzle at the nozzle end of a manually actuated liquid dispenser, the nozzle being mounted for rotation between discharge open and closed positions. The overcap has an opening in its end wall and is mounted on the nozzle for manual axial movement between extended and retracted positions and is rotatable together with the nozzle. A flat surface of the overcap overlies the flat surface of the dispenser body in the retracted position for resisting rotation of the nozzle from its closed position. The overcap in its extended position permits rotation of the nozzle from its closed position to its open position.

7 Claims, 1 Drawing Sheet

DISPENSER HAVING CHILD-RESISTANT NOZZLE ASSEMBLY

BACKGROUND OF THE INVENTION

This i relates generally to a manually actuated fluid dispenser, and more particularly to a rotatable nozzle assembly for such dispenser capable of being easily and effectively locked in its off position against rotation from such position, thereby rendering the nozzle child-resistant.

Child-resistant nozzle assemblies for manually actuated fluid dispensers have been devised, but are not without their limitations. For example, a known nozzle cap has a slot in its upstream end, and a flexible lug on the dispenser body is received within the slot to prevent the nozzle from turning. Another known nozzle cap has an internal shoulder engageable by a spring biased tab on the dispenser body to prevent rotation of the cap from its OFF position.

In both prior art assemblies, the lug or tab is manually depressable inwardly for unlocking the cap to permit cap rotation to facilitate fluid discharge. Such a depressable lug or tab is, however, awkward and oftentimes difficult to operate even by an adult.

Thus, the need arises for the provision of a child-resistant nozzle assembly which is quickly and more easily operable by an adult and which at the same time is incapable of being readily operated by a child. The child-resistant nozzle assembly is desirable for dispensers of especially cleaning and other household fluids which may be toxic.

SUMMARY OF THE INVENTION

It is therefore an object of the present invention to provide a child-resistant nozzle assembly for a manually actuated fluid dispenser which avoids the aforementioned drawbacks of the prior art, and which is highly effective in quickly and easily locking the nozzle cap in its OFF position, while being of simple construction, more economical to produce, and more efficient in its operation.

The anti-rotative, child-resistant nozzle assembly according to the invention is adapted for a nozzle cap of rectangular cross-section presenting flat outer side surfaces. The nozzle is mounted on the dispenser body for rotation, without axial movement. between discharge open and closed positions. A child-resistant element is mounted on the nozzle for manual axial movement between extended and retracted positions and is rotatable together with the nozzle. Such element engages external stop means on the dispenser body in the retracted position for resisting rotation of the nozzle from the discharge closed position. And, the element in its extended position permits rotation of the nozzle from its closed position to its open position Such element may comprise an overcap, and the dispenser body may have a flat outer surface comprising the stop means. The overcap has a flat wall overlying such flat outer surface in the retracted position of the overcap.

Limit stops acting between the overcap and the nozzle limit movement of the overcap in its extended position. One or more of such limit stops on the overcap may be provided by one or more internal tines which each include a stop shoulder, the nozzle having an opening for each tine which includes a limit stop.

The overcap is of generally the same configuration as that of the nozzle to facilitate nozzle rotation in the extended position of the overcap by simply rotating the overcap.

The nozzle may have discharge open and closed indicia on the flat faces thereof, such as SPRAY, STREAM and OFF, and the overcap may be of translucent or transparent material to permit the operator to view the indicia through the overcap as the nozzle is rotated in the extended position of the overcap.

Other objects, advantages and novel features of the invention will become more apparent from the following detailed description of the invention when taken in conjunction with the accompanying drawings.

DETAILED DESCRIPTION OF THE INVENTION

Figure 1:
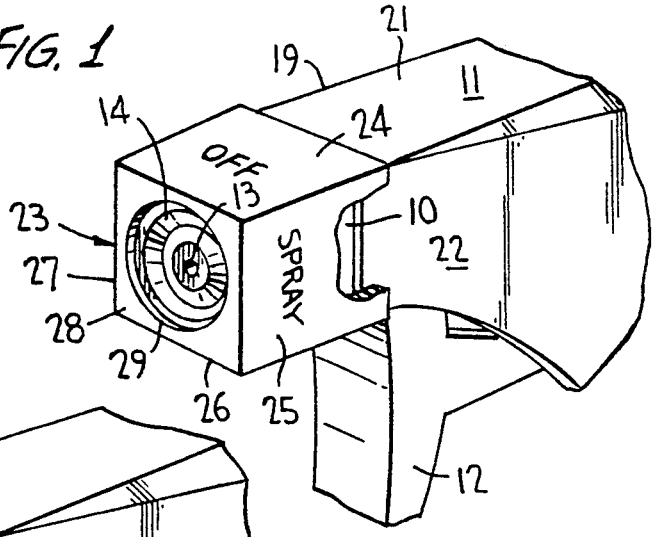
FIG. 1 is a perspective view of part of a dispenser incorporating the invention showing the nozzle locked in its OFF position.
Figure 2:
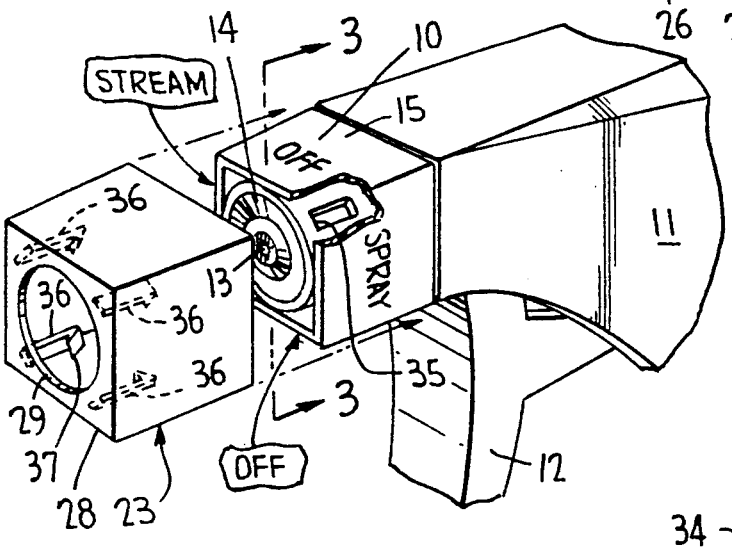
FIG. 2 is a view similar to FIG. 1 showing the child-resistant overcap of the invention in expanded view for clarity.
Figure 3:
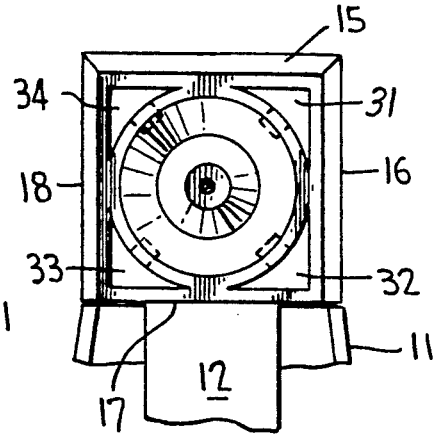
FIG. 3 is a front end elevational view of the nozzle, taken substantially along the line 3—3 of FIG. 2.

Turning now to the drawings wherein like reference characters refer to like and corresponding parts throughout the several views, a nozzle cap generally designated 10 is coupled as by snap-fitting to dispenser body 11 of a trigger-actuated dispenser having a trigger actuator 12. The nozzle is rotatable about its central axis, without axial movement, between spray-off and stream-off positions. The structural details of such nozzle assembly are disclosed in U.S. Pat. No. 4,706,888, the disclosure of which is specifically incorporated herein by reference.

The nozzle is generally rectangular in cross-section, having a discharge orifice 13 in its front face 14. Flat outer faces 15, 16, 17 and 18 of the nozzle may be respectively marked with OFF, SPRAY, OFF, and STREAM indicia. In the two OFF positions, faces 15 and 17 face upwardly, and the discharge is closed in either of these OFF positions. The cap has an internal groove which receives an annular rib on the nozzle end of the dispenser body for snap-fitting the nozzle in place, as disclosed in U.S. Pat. No. 4,706,888. And, adjacent its nozzle end, the dispenser body has flat outer surfaces 19, 21, 22.

A child-resistant element 23 of the invention, which may be in the form of an overcap, is of the same general rectangular cross-section as that of the nozzle, with flat faces or walls 24, 25, 26, 27 thereof respectively overlying flat faces 15 to 18 of the nozzle. The overcap is coupled to the nozzle for sliding movement along its central axis between its retracted position of FIG. 1 and its extended position of FIG. 4. Walls 24 to 27 of the overcap are of sufficient length to partially span and overlie the flat outer surfaces of the dispenser body, in the retracted position of FIG. 1. It should be pointed out that the dispenser body is undercut in the vicinity of trigger 12 to accommodate wall 26 of the overcap without interference. And, outer wall 28 of the overcap has an enlarged opening 29 coaxial with discharge orifice 13 to facilitate the discharge of product from the dispenser, without interference, as the nozzle cap is rotated to one of its discharge open positions.

Figure 4:
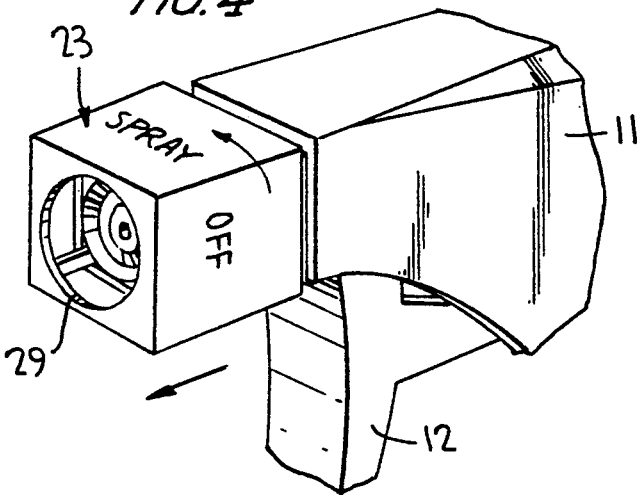
FIG. 4 is a view similar to FIG. 1 showing the child-resistant overcap of the invention extended and the nozzle turned to one of its on (such as SPRAY) positions.

The overcap may be of translucent or transparent plastic material, rendering the OFF, SPRAY and STREAM markings on the nozzle visible to the operator. Therefore, in the retracted position of the overcap with the nozzle in one of its discharge closed positions, the nozzle itself is inaccessible and is locked against rotation from its OFF position by the overcap which spans the nozzle and the flat surfaces of the dispenser body. Upon manually extending (pulling) the overcap to its position of FIG. 4, until the rearward edge of the overcap clears the forward edges of the flat surfaces of the dispenser body, the nozzle is capable of being rotated from its OFF to one of its open discharge positions, OFF, SPRAY shown in FIG. 4, by simply grasping the rectangular overcap and rotating it counterclockwise as shown in FIG. 4. The nozzle simply rotates together with overcap rotation either counterclockwise as shown, or clockwise, into its STREAM position.

Figure 5:
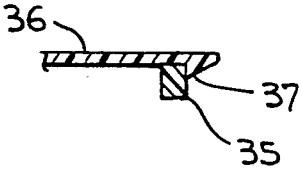
FIG. 5 is a detail view of the limit stops acting between the overcap and the nozzle for limiting the overcap in its extended position.

The overcap is limited in its travel to its FIG. 4 position by limit stops acting between the overcap and the nozzle. Openings 31, 32, 33, 34 extending through front face 14 of the nozzle are each provided with stop shoulders 35, as more clearly represented in FIG. 5. Internal tines 36 within the cap extend into openings 31 to 34, each of the tines having stop shoulders 37 which, in the retracted position of FIGS. 4 and 5, abut against shoulders 35 for limiting the outward extent of the overcap to its FIG. 4 extended position. Of course, other cooperating limit stops between the overcap and the nozzle can be provided without affecting the scope of the invention.

The child-resistant nozzle assembly of the invention is streamlined with the dispenser body and nozzle, thereby maintaining the overall appearance of a typical trigger actuated dispenser, except that the nozzle is difficult, if not impossible, to be operated by a child. The intended operator simply extends the overcap to its FIG. 4 position and rotates the cap in either direction, which thereby rotates the nozzle to one of its open discharge positions. For safety, the operator will simply rotate the nozzle by turning the overcap back to its OFF position and will retract the overcap back to its FIG. 1 locked position. The SPRAY, STREAM and OFF indicia are clearly visible through the transparent or translucent overcap, thereby avoiding any confusion by the operator as to the open and closed condition of the dispenser.

Obviously, many modifications and variations of the present invention are made possible in the light of the above teachings. It is therefore to be understood that within the scope of the appended claims the invention may be practiced otherwise than as specifically described

What is claimed is:

1. A manually actuated liquid dispenser comprising a dispenser body for mounting with a closure cap to the upper end of a container for fluent product, said body extending transversely above the closure, cap, said body having means defining a pump chamber having an inlet port in communication with a valve controlled inlet passage, said chamber being in communication with a valved discharge passage extending in a forward direction, a discharge nozzle having a discharge orifice in communication with said discharge passage, said nozzle being mounted on said body adjacent a forward end of said body for rotation between discharge open and closed positions upon manual rotation of said nozzle about a central axis thereof, manually operable means on said pump body for pressurizing said chamber for expelling product through said discharge orifice, a child-resistant element mounted on said nozzle for manual axial movement between extended and retracted positions and being rotatable together with said nozzle, said element comprising an overcap having an opening coaxial with said discharge orifice, external stop means on said body, said element engaging said stop means in said retracted position for resisting rotation of said nozzle from said closed position, and said element in said extended position permitting rotation of said nozzle from said closed position to said open position.

2. The assembly according to claim 1, wherein said forward end of said body has a flat outer surface comprising said stop means, said overcap having a flat wall overlying said flat outer surface in said retracted position.

3. The assembly according to claim 1, wherein said nozzle and said overcap respectively have first and second stop shoulders for limiting movement of said overcap in said extended position.

4. The assembly according to claim 1, wherein said overcap has an internal tine including a stop shoulder, and said nozzle has an opening including a limit stop, said tine extending into said opening, and said shoulder abutting said limit stop in said extended position.

5. The assembly according to claim 1, wherein said nozzle has a flat face, said forward end of said body having a flat outer surface comprising said stop means, and said overcap having a flat wall overlying said flat face and said flat outer surface in said retracted position.

6. The assembly according to claim 5, wherein said overcap has the same general configuration as that of said nozzle.

7. The assembly according to claim 6, wherein said nozzle is of rectangular cross-section having discharge open and closed indicia on the faces thereof, said overcap being one of a translucent and a transparent material to permit exposure of said indicia through said overcap.

* * * * *